US005189859A

United States Patent [19]

Payer

[11] Patent Number: 5,189,859

[45] Date of Patent: Mar. 2, 1993

[54] MODULIZED SPACE TRUSS ASSEMBLY

[76] Inventor: William J. Payer, 4860 Parkview Mine Dr., Sugar Hill, Ga. 30518

[21] Appl. No.: 754,948

[22] Filed: Sep. 4, 1991

Related U.S. Application Data

[63] Continuation-in-part of Ser. No. 548,021, Jul. 5, 1990, abandoned.

[51] Int. Cl.[5] ..... E04C 3/20

[52] U.S. Cl. ..... 52/585; 52/407; 52/439; 405/259.6

[58] Field of Search ..... 52/405, 407, 300, 309.12, 52/309.15, 439, 585, 227; 138/111, 115, 117; 411/82, 258; 405/259.6

[56] References Cited

U.S. PATENT DOCUMENTS

| | | | |
|---|---|---|---|
| 2,929,236 | 3/1960 | Steward et al. | 52/585 X |
| 3,036,407 | 5/1962 | Dixon | 52/439 |
| 3,166,873 | 1/1965 | Rosenfeld | 52/439 |
| 3,292,331 | 12/1966 | Sams | 52/586 X |
| 3,594,971 | 7/1971 | Hughes | 52/585 X |
| 3,702,060 | 11/1972 | Cumming | 405/259.6 |
| 3,800,015 | 3/1974 | Sachs | 52/309.12 |
| 3,899,005 | 8/1975 | Klimpl | 138/111 |
| 4,249,354 | 2/1981 | Wynn | 52/439 X |
| 4,614,071 | 9/1986 | Sams et al. | 52/405 X |
| 4,652,193 | 3/1987 | Hibbs | 411/82 |
| 4,756,134 | 7/1988 | Murphy | 52/407 X |

*Primary Examiner*—Richard E. Chilcot, Jr.
*Assistant Examiner*—Kien Nguyen

[57] ABSTRACT

A component (1) and an assembly of components (1) arranged in a running bond coarsing pattern. As a result of this pattern, the assembly forms a space truss load resisting system. The components (1) are of a size consistent with hand insertion within the assembly. The truss chord reinforcing members (2) couple as connections between components (1). These connections provide the gap (37) required between components (1) due to component (1) manufacturing and field erection tolerances. The component (1) could be made from a multiplicity of materials structurally working in conjunction with each other.

19 Claims, 7 Drawing Sheets

FIG 21
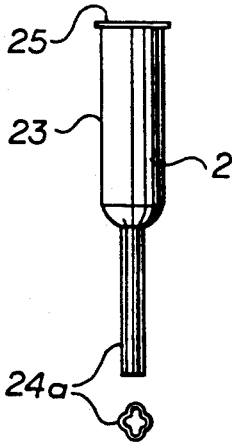
FIG 22
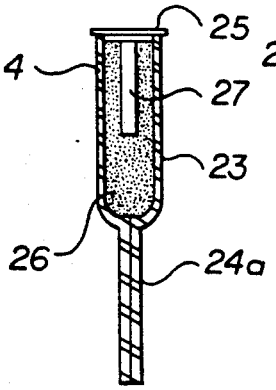
FIG 23
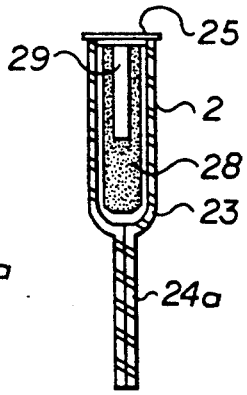
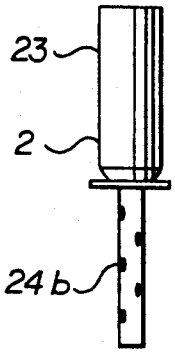
FIG 24
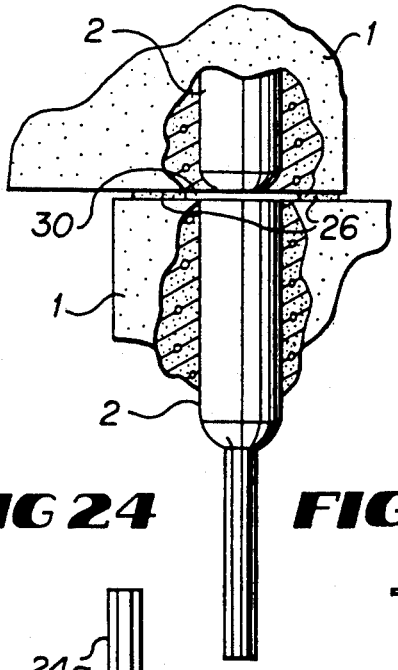
FIG 25
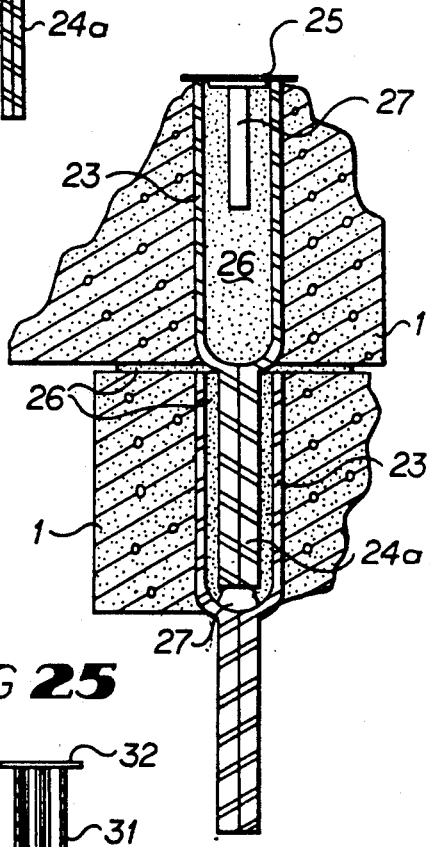
FIG 26
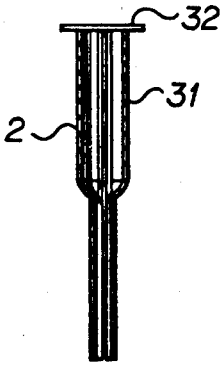
FIG 29
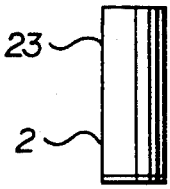
FIG 27
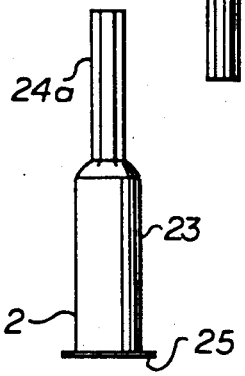
FIG 28

FIG 30
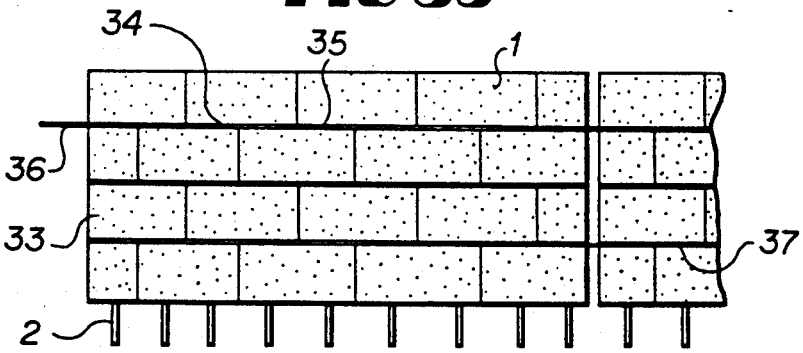
FIG 31
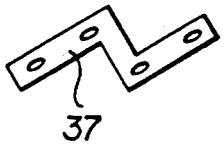
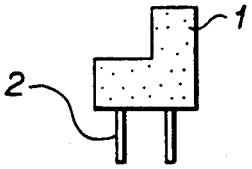
FIG 32
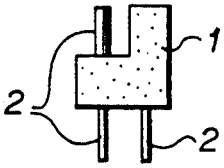
FIG 33
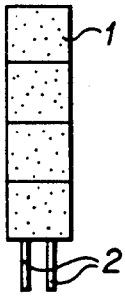
FIG 34
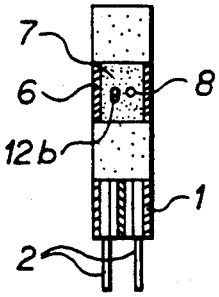
FIG 35
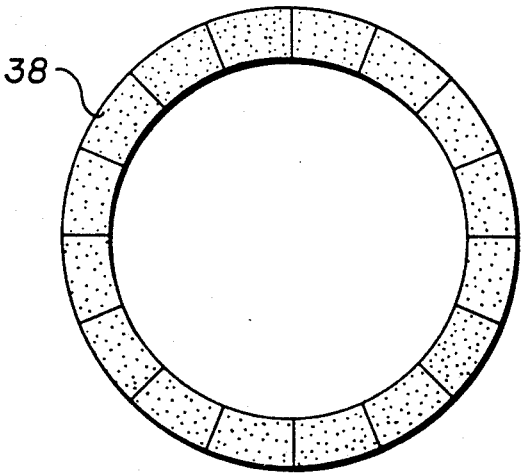
FIG 36
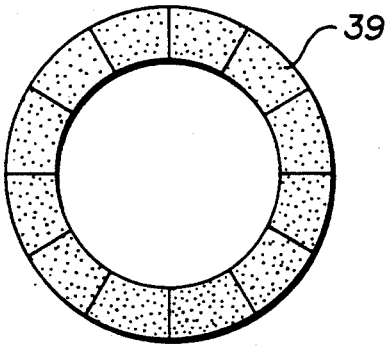
FIG 37

MODULIZED SPACE TRUSS ASSEMBLY

REFERENCE TO RELATED APPLICATION

This is a continuation-in-part of application Ser. No. 07/548,021 filed Jul. 5, 1990 now abandoned.

BACKGROUND OF THE INVENTION

1. FIELD OF INVENTION

This invention relates to an assembly of components to be used in a structure primarily for the purpose of resisting loads.

2. DESCRIPTION OF PRIOR ART

The present-day construction of concrete block assemblies requires a multiplicity of materials at the construction site. Mortar and grout are usually field placed and field mixed. Horizontal and vertical reinforcing bars must also be field arranged within the block assemblies. Vertical reinforcing positioning through block cells is a difficult task with questionable results.

The weather is also a major problem for exterior block construction. Precipitation of any sort dilutes the quality of mortar and grout mixes. The air temperature is also a major concern of the industry.

Placement of the block requires skilled laborers proficient in the art of blocklaying. Industry experts predict a shortage of proficient blocklayers. Even after assembly construction, the structure must be skillfully braced until sufficient set of the mortar mix. The usual end effect of temporary bracing is that it increases the time allotted and the risk taken in the construction process. Also, due to the uncertainties in existing block technology, trained inspectors and field material test must be provided in order that efficient use of assembly material strengths be utilized. With this in mind, a knowledgeable owner should almost always consider the quality built within his structure.

Present building construction methods also require poured concrete grade beams and/or strip footings. Blockwall systems laid on these poured foundations do not progress until the concrete has gained sufficient strength. Again, the construction time for project completion has increased.

Installations of current block assemblies, especially that of reinforced systems, require relatively large amounts of material resources, including fresh, clean water. Unused mortar or grout must be disposed of properly, thereby, increasing project cost and environmental concerns. Also, workers expose themselves to caustic substances that may result in serious health consequences.

U.S. Pat. Nos. 3,369,334 which issued Feb. 20, 1968 to R. R. Berg and 1,385,606 which issued Jul. 26, 1921 to J. A. F. Christensen discloses a method for attaching concrete modular units. Both systems require extensive tooling of units if the screw type attachment mechanisms are to work effectively in the field. U.S. Pat. No. 4,249,354 issued by Wynn teaches a reinforced wall construction. This wall construction relies on field placement of reinforcing and extensive use of field placed grout.

SUMMARY OF THE INVENTION

The modulized space truss assembly teaches that an assembly of components being comprised of unique component reinforcing members, being juxtaposed with a running bond component coarsing pattern and being coupled with a unique type of component attaching mechanism, accrues the primary following benefits over the prior art:

1) Increases assembly quality.
2) Reduces erection time.
3) Lessens risk to field personnel.
5) Develops new markets for component systems.
6) Increases structural strength and reliability of component assemblies.
7) Decreases material utilization.
8) Decreases complexity of component assembly for the field laborer.

An object of this invention is to provide factory control of installation of grout mixtures. For most uses, grout will be factory installed. This grout will contain a retarding agent such as Mortard produced by the W. R. Grace & Co. or Delvo by the By Master Builders, Inc. A typical accelerator agent compatible with the retarding agent is place with or on top of the grout mixture and upon coupling of adjacent components, initial set of the group mixture occurs in a time frame permitting economical installation of adjacent coarsing components. Also, upon coupling of adjacent units the grout mixture spills outside the grout placement vessel, thereby, sealing the adjacent components together. The grout mixture will also have the consistency to balance the weight of adjacent coarsing components prior to initial set, thereby, providing the gap required for component manufacturing and erection tolerances. A factory installed component interface material, if necessary, seals the gap. This material will not be degraded by block stacking during the shipping process.

An overall object of the invention is to provide a space truss system in a modulized arrangement. Utilizing a running bond coarsing configuration with the truss chord and web members positioned within the component, linkage of the components within the assembly results in a two-way load reinforcing system. An obvious result of this arrangement is that the typical horizontal joint reinforcing necessary in present-day construction is not required. Another result is that when the space truss system is coupled with the block configuration an efficient system in resisting earthquake or dynamic loads is developed.

Another overall object of this invention is to provide for a more efficient attaching mechanism between primary reinforcing members. Besides providing the construction tolerance between adjacent components, the mechanics of the attaching mechanism also result in removing some of the risk to the field laborer from potential wall or assembly collapses. Costly wall bracing for most applications of the assembly will not be required. Correspondingly, various insurance costs of the project should be lowered due to the lessening of risk.

A further benefit resulting from this invention is that the field laborer will have less exposure to caustic substances. No field mortar or grout will be required if there are no special construction requirements.

A significant advantage of the assembly is the increase in the number of applications for component system use beyond current practices. As a result of the interlocking mechanism being confined, the assemblage may be build below the water surface without significant impact to assembly capacity. Placement of the proper truss web material results in a security block able to withstand impactive loads. Such a system could be easily utilized for security vaults, prison enclosures, blast resistant structures and security walls for residential, commercial and industrial interest. Still another advantage of the component system reinforcing members is that a tieback earth retaining wall system could be easily utilized by placement of a thin ringlike attachment about the chord reinforcing members. These ringlike attachments could be easily utilized for many wall application connections. Yet another application of the invention is use of such a system for home improvement projects. This application could use a wire chord or partitioned tube reinforcing system placed in the field on a component basis. Such an assembly could utilize an epoxy bonding agent placed in prepacked containers ready for direct insertion into component chord openings. Still another application resulting from the space truss configuration is that the component could be easily insulated by rigid insulation between the exterior panel walls. Thus the assembly may be utilized for structures requiring control of the thermal environment, such as refrigeration units. In any enclosed temperature controlled building wall application, the result of insulated component would be energy conservation. Also, this type of component lends itself effectively to soundproofing with direct application to sound studios. Yet another application of the overall invention resulting from the limited gap between components in assemblies is a more aesthetically looking wall surface than current practice produces. The structure viewed from a short distance appears as a cast, poured assemblage. With the ease in forming variances in the corresponding new type molds, architectural wall surface appearances will be greatly expanded over conventional block architectural treatments in modular construction. Still another application of the assemblage is that due to the ringlike attachments, mentioned previously in this section, a direct hookup with a small electric current results in severe cold weather construction of the assembly. On the other hand severe hot weather application could be negotiated with proper control of the bonding agent.

Another object of this invention is to decrease material utilization. Large amounts of mortar and, if system is reinforced, grout are spent. Fresh, clean water is a necessity in present construction methods. This invention's interlocking mechanism requires grout placement in a small, closed environment. Thus less materials are utilized and wasted, lessening the environmental impact of placement of unused mortar and grout, mixtures and equipment wash on ground surfaces.

Yet another application of the invention is that wall or structure assemblies may be efficiently built horizontally on ground surfaces and almost immediately lifted up into position. A similar advantage is that a slab system may be build on a component basis without a need for forms required for a poured concrete construction.

A significant object of this invention is the lessening of difficulties in block assembly construction. Less field expertise is required for block installation.

A particular note concerning this invention is that the foundation could be excavated the same day the roof assemblage is placed without regard to major weather difficulties.

A further note concerning this invention is that the typical block may be reinforced by present day techniques in addition to the space truss reinforcing system.

BRIEF DESCRIPTION OF THE DRAWING

While the specification conclude with claims particularly pointed out and distinctly claiming the subject matter recorded as forming the present invention, it is believed the invention will be better understood but not limited to the following description taken in connection with the accompanying drawings in which:

FIG. 21 shows a front elevation of a singular component chord member.

FIGS. 22 and 23 show section views of a singular component chord member with different bonding agents.

FIG. 24 shows a front elevation of a singular component chord member.

FIG. 25 shows a fragmentary torn away partial front elevation view of adjacent components chord members in an engaged state.

FIG. 26 shows a fragmentary section view of adjacent components chord members in an engaged state.

FIG. 27 shows a front elevation view of a singular specialized chord member.

FIG. 28 shows a front elevation view of a singular chord member in a specialized configuration with respect to that shown in FIGS. 21 through 24.

FIG. 29 shows a front elevation view of a singular specialized wire chord member.

FIG. 30 shows a front elevation view of the typical wall assembly of the modulized space truss.

FIG. 31 shows a plan view of a particular weldment used with the typical wall assembly presented in FIG. 30.

FIGS. 32 and 33 show side elevation views of a specialized component such as a beam seat used with the typical wall assembly presented in FIG. 30.

FIG. 34 shows a side elevation of the typical wall assembly presented in FIG. 30.

FIG. 35 shows a section view utilizing different component types as shown in FIGS. 6 through 9 utilized in the typical wall assembly presented in FIG. 30.

FIG. 36 shows a top plan view of a type of assembly configuration comprising of large curved shapes such as silos.

FIG. 37 shows a top plan view of a type of assembly configuration comprising of small curved shapes such as columns or pipe sections.

DESCRIPTION OF A PREFERRED EMBODIMENT

Figure 1:
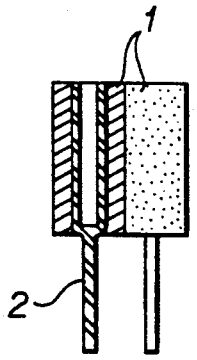
FIG. 1 shows a section side elevation view of the component showing the reinforcing members in place.
Figure 2:
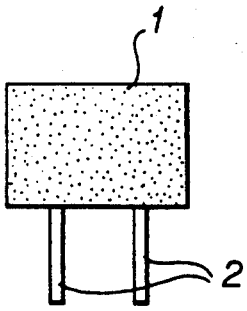
FIG. 2 shows a front elevation view of the component showing the reinforcing members in place.

Referring now to the drawings in which, identical or nearly identical features are designated by the same designations, FIG. 1 shows a section side elevation view of preferred component 1 configuration taken at the chord reinforcing member 2. FIG. 2 shows a front elevation view of component 1 with chord reinforcing members 2 positioned for typical component alignment.

Figure 3:
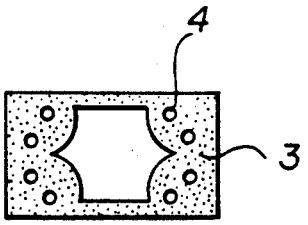
FIG. 3 shows a plan view of a multi-use component without reinforcing members in place.

FIG. 3 shows a plan view of multi-use component 3 with series of continuous shafts 4 positioned for specialized use at assembly corner or other situations of like abutting with components 1. Chord reinforcing member 2 as shown in FIG. 2 may be placed within shaft to provide for continuity of reinforcement within the assembly.

Figure 4:
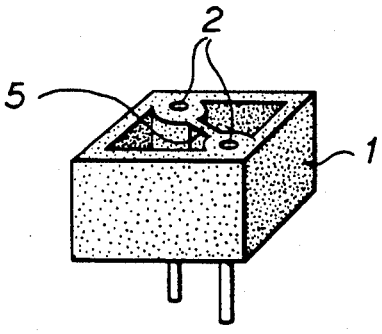
FIGS. 4 and 5 show perspective views of the two necessary component types with each component having reinforcing members shown in place uniquely positioned for each component, embodying the modulized space truss assembly invention.
Figure 5:
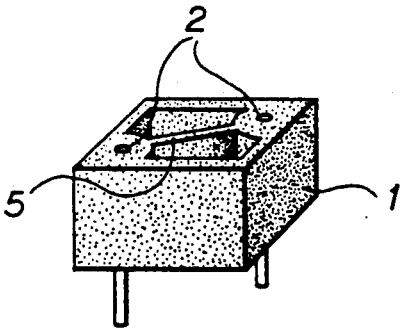

FIGS. 4 and 5 shows perspective views of the two typical component 1 types necessary for chord reinforcing member 2 to be utilized in the preferred embodiment of the space truss configuration. The two components 1 are coupled when adjacent chord reinforcing members 2 (the right chord reinforcing member 2 of FIG. 4 and the left chord reinforcing member 2 of FIG. 5) are interlocked. Truss web panel reinforcement 5 is shown in the preferred embodiment connecting the chord reinforcing members 2. This truss web panel reinforcing 5 arrangement provides for a direct transfer of forces between chord reinforcing members 2.

Figure 6:
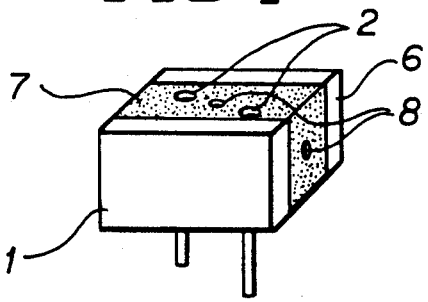
FIGS. 6 through 9 show perspective views of specialized components. In numerical order these figures present a concrete exterior panel component, a steel exterior panel component and a concrete component without a concrete web panel. All components are shown with reinforcing members in place.

FIG. 6 shows a perspective view of the concrete panel 6 component 1. Chord reinforcing members 2 are shown in the same alignment as positioned in FIG. 4. Chord reinforcing members 2 are structurally attached and interact with the concrete panels 6 in a composite action nature. Rigid insulation 7 is sandwiched between concrete panels 6. Openings 8, extending continuously through the component, provide runways for electrical wiring. For various types of truss web panel reinforcement 5 that could be utilized in the concrete panel 6 component 1 see FIGS. 14 through 20.

Figure 7:
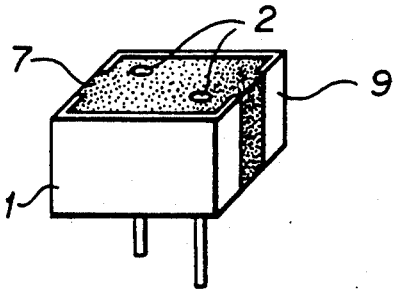
Figure 8:
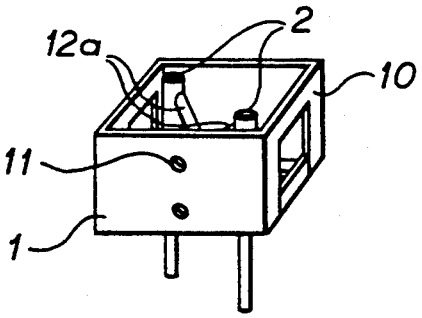
Figure 9:
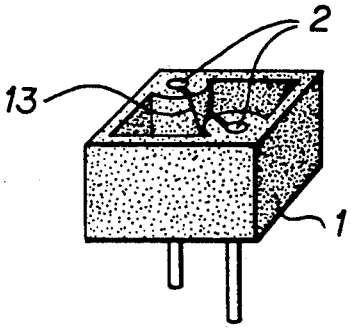

FIGS. 7 through 9 components 1 are similar to that component 1 shown in FIG. 6. FIG. 7 shows a perspective view of a ceramic panel 9 component 1. FIG. 8 shows a perspective view of a metal panel 10 component 1. Knockout openings 11 could be provided to permit ease of pipe or conduit routing through assembly wall. Double compression strut web reinforcement 12*a* provides for a direct transfer of forces between chord reinforcing members 2. FIG. 9 shows a perspective view of a concrete component 1. Tension wire web reinforcement 13 provides for a direct transfer of forces between chord reinforcing members. Truss web panel reinforcement 12*a*, 12*b*, 13, 20, 21, 22 shown in FIGS. 14 through 20 are for the most part interchangeable depending upon the application and strengths required.

Figure 10:
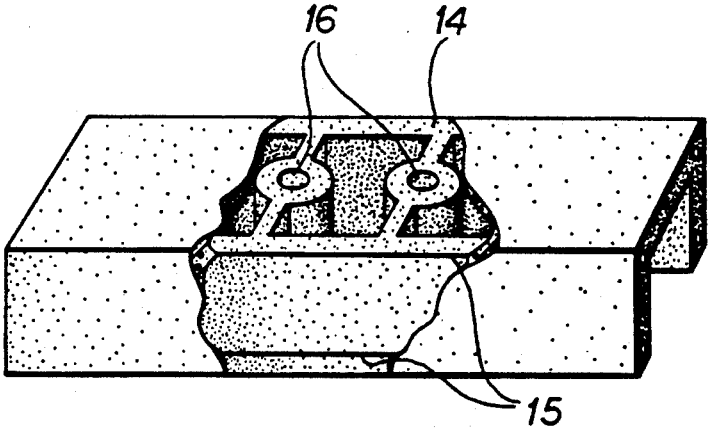
FIG. 10 shows a perspective partially torn view of a specialized component typically used in footings. Component is shown with reinforcing members in place.

FIG. 10 shows a perspective view of a footing component 14. Footing reinforcing bars 15 extend the length of footing component 14. The footing reinforcing bars 15 are placed at the footing component 14 four corners. The partially torn view shows shafts 16. Shafts 16 are positioned throughout footing component 14. The reinforcing member 2 type that is used for insertion into shafts 16 will typically be vessel 23 as shown in FIG. 27. The open side of vessel 23 is either top or bottom depending on the particular position of reinforcing member 2 of the coupling component 1.

Figure 11:
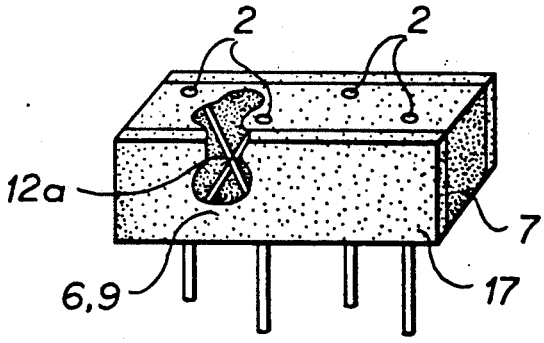
FIG. 11 shows a perspective view of concrete or ceramic exterior panel component of elongated length over that of the typical invention's component with a partially torn section showing the truss web members. Component is shown with reinforcing members in place.

FIG. 11 shows a perspective view of an elongated component 17. Exterior panels 6,9 are either concrete or ceramic depending on weight limitations. Rigid insulation 7 is utilized for both the structural properties and lightweight nature associated with the filler material. The partially torn section shows double compression strut web reinforcement 12*a* utilized between reinforcing members 2.

Figure 12:
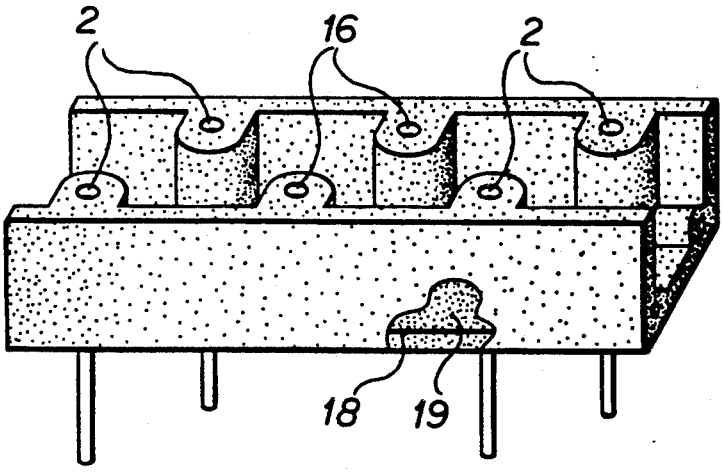
FIG. 12 shows a perspective partially torn view of a specialized component typically used as a building's lintel. Component is shown with reinforcing members in place.

FIG. 12 shows a perspective view of a lintel component 19. Lintel reinforcing bars 18 extend continuously along the corners adjacent to the opening in the assembly. Reinforcing members 2 are positioned at both ends of the lintel component 19. Shafts 16 are located in the interior part of lintel component 19 spanning continuously between reinforcing member 2, positioned to correspond with coupling from above of component 1.

Figure 13:
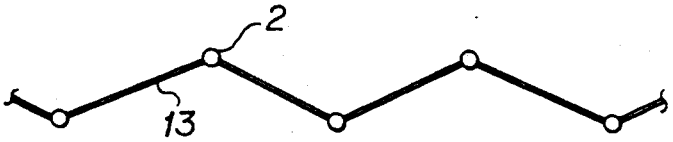
FIG. 13 shows a plan view of the truss members of the embodying modulized space truss assembling invention.

FIG. 13 shows a plan view of the embodying truss configuration of the invention and reflects the truss arrangements shown in FIGS. 14 through 20. Tension wire web reinforcements 13 spans between reinforcing members 2.

Figure 14:
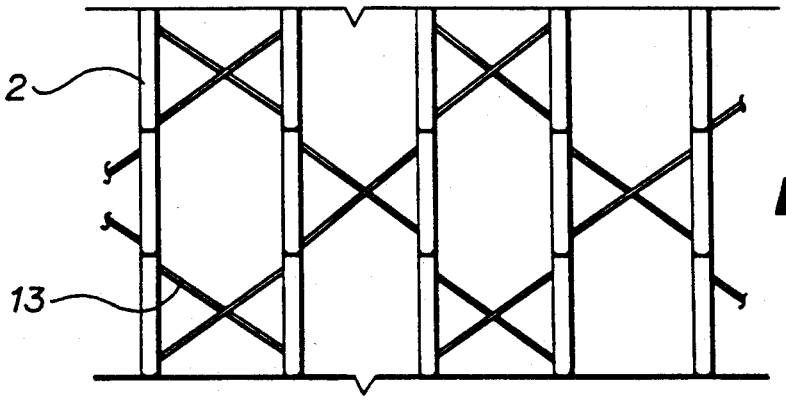
FIG. 14 shows a front elevation view of the truss members of the assembly with tension resisting web sections.
Figure 15:
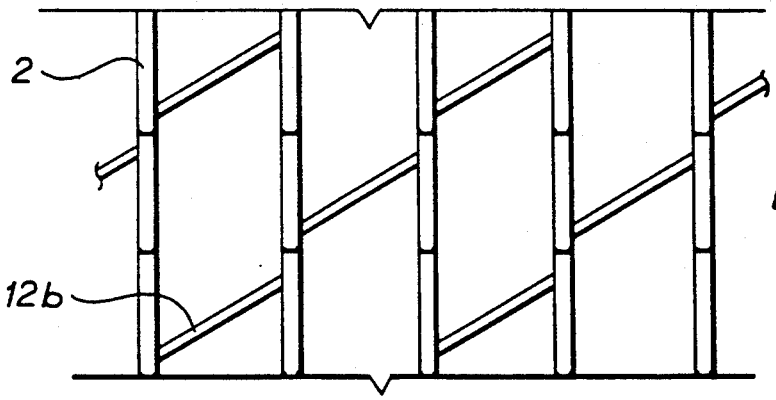
FIG. 15 shows a front elevation view of the truss member of the assembly with compression resisting web sections.

FIGS. 14 and 15 show a front elevation view of the unique positioning of the tension wire web reinforcements 13 and the single compression strut web reinforcements 12*b* resulting from component 1 placement requirements.

Figure 16:
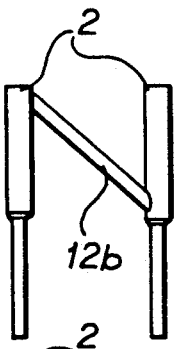
FIGS. 16 through 20 show front elevation views of component truss member or members configurations. In numerical order these figures present a single strut compression resisting web section, a tension resisting web section with web members continuous along truss chords, a concrete or fiber reinforced concrete web panel between and attached to the truss chords, a double strut compression resisting web section and a combination tension resisting and compression resisting web section.
Figure 17:
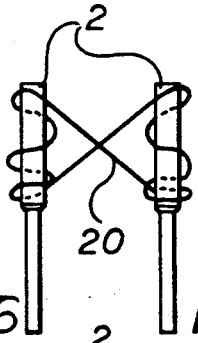
Figure 18:
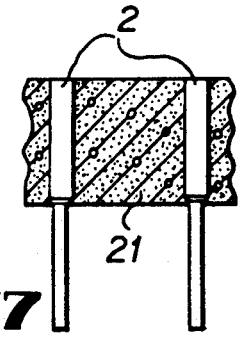
Figure 19:
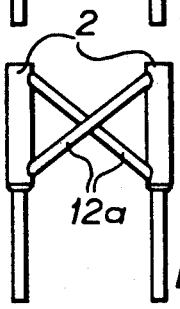
Figure 20:
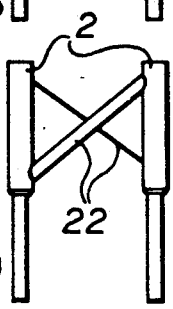

FIGS. 16 through 20 show the various configurations of transferring forces between reinforcing members 2. FIG. 16 utilizes a single compression strut web reinforcement 12*b* with strut high side on left side of assemblage as compared with the high side on right as shown in FIG. 15. FIG. 17 utilizes a tension wire crisscross pattern 20 with wire system wrapped around the reinforcing members 2. FIG. 18 utilizes a concrete or fiber reinforced concrete shear panel 21 with type of material depending on structural load requirements. FIG. 19 depicts a double compression strut web reinforcement 12*a*. FIG. 20 shows a combination tension wire and compression strut web reinforcement 22.

FIGS. 21 through 29 show the pipe members 23 of the reinforcing members 2 in a singular state and also in a state embodying this invention, that is with the adjacent reinforcing members 2 being engaged.

FIG. 21 shows an elevation view of a reinforcing member 2 consisting of pipe member 23 with approximately ½ of length adequately swedged to permit proper insertion of prong member 24*a* into adjacent component 1 pipe member 23. Cap 25 seals the pipe member 23.

FIG. 22 shows a section view of FIG. The cementitious bonding agent 26 and the cementitious bonding agent accelerator capsule 27 is shown placed within the pipe member 23. Cap 25 seals the, if required, factory installed cementitious bonding agent 26 and cementitious bonding agent accelerator capsule 27.

FIG. 23 is similar to FIG. 21 with an epoxy bonding agent 28 used in conjunction with the epoxy bonding agent catalyst 29.

FIG. 24 shows an elevation view of a variation of the pipe member 2 shown in FIG. 21. The pipe member 2 is comprised of pipe section 23 structurally attached to a prong member 24*b* consisting of a deformed rod, with the attachment providing a transfer of a high percentage of forces between pipe section 23 and prong member 24*b*.

FIG. 25 shows a partial front elevation view of adjacent components 1 reinforcing members 2 in an engaged state. The fragmentary torn away view depicts the bonding agent overflow 26 and the, if required, adjustment washer 30.

FIG. 26 is an extended section of FIG. 25. Cementitious bonding agent accelerator capsule 27 is shown with adjacent components 1 reinforcing members 2 in a fully inserted state. FIG. 27 shows an elevation view of reinforcing member 2 comprised of pipe member 23 only. FIG. 28 is similar to FIG. 21 with the prong member 24*a* positioned on top of the pipe member 23. FIG. 29 shows an elevation view of a wire constructed reinforcing member 31 utilized in some application methods as an alternate for the reinforcing member 2 depicted by FIG. 21. Wire ring 32 acts mainly as a restraining mechanism for wire constructed reinforcing member 31 placement into component 1.

FIGS. 30 through 35 depict a typical wall assembly. FIG. 30 shows a front elevation view of coarsing 33 shown in a running bond configuration. A gap 37 between adjacent components 1 is required for construction tolerances. A bonding agent and/or sealant mixture is positioned, if necessary, within the gap 37. Attachment ring 35, attachment strap 36 and joint slide plate 37 show, if required, modifications resulting from assembly use requirements. Attachment ring 35 connects structurally to assemblages exerting either compression or tension forces. The attachment ring 35 is placed about the reinforcing member 2. Attachment strap 36 provides an attachment to an adjacent modular structural system such as a brick wall. Joint slide plate 37 provides structural control over differential wall assembly movements at the joint interface.

FIG. 31 shows a plan view of the joint slide plate 37 as described within those descriptions given for FIG. 30.

FIGS. 32 and 33 show side elevation views of, if required, beam seat modification of the typical wall assembly as shown in FIG. 30.

FIG. 34 shows a side elevation view of the typical wall assembly as shown in FIG. 30. FIG. 35 shows a section view of the typical wall assembly as shown in FIG. 30 utilizing different wall components 1 types as shown in FIGS. 4 and 6.

FIG. 36 shows a plan view of an assemblage characterized by a large radius component 38 such as grain silos.

FIG. 37 shows a plan view of an assemblage characterized by a small radius component 39 such as pipes or columns.

Figure 38:
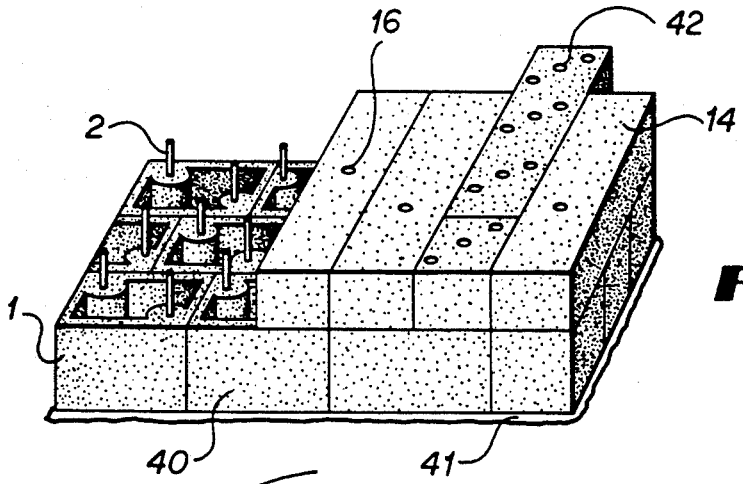
FIG. 38 shows a perspective view of a type of assembly configuration used typically for foundation purposes.

FIG. 38 shows a perspective view of a strip wall footing 40 assemblage. A leveling mat 41 is provided to aid in correct placement of above components 1. Multiuse footing component 42 is strategically positioned to distribute loads placed by above components 1 between separate wall footing 40 assemblages.

Figure 39:
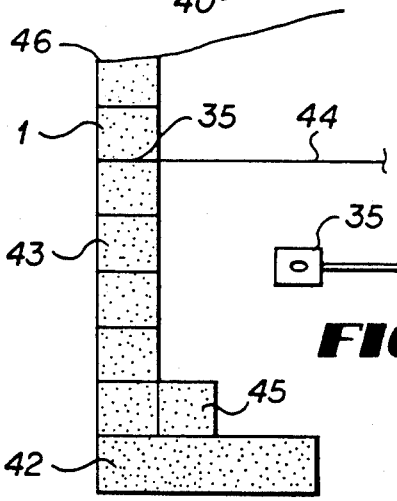
FIG. 39 shows a side elevation view of a type of assembly configuration used typically for retaining earth.
Figure 40:
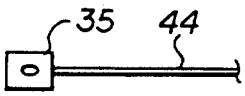
FIG. 40 shows a plan view of a particular weldment used for tieing back the type assembly configuration shown in FIG. 39.
Figure 41:
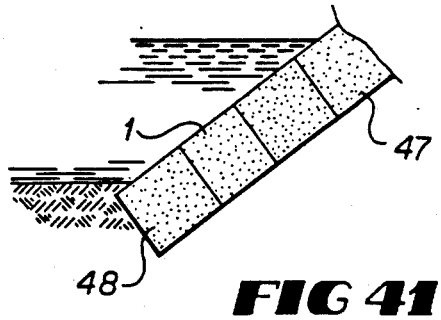
FIG. 41 shows a side elevation view of a type of assembly configuration used typically for protection of embankments below or above the waterline.

FIG. 39 shows a side elevation view illustrating an earth restraining assemblage 43. Tierod 44 is attached to attachment ring 35 with the attachment ring 35 as described within those descriptions given by FIG. 30. Cap component 46 is mainly used to seal the top of a typical wall assembly in this case an earth retaining assemblage 43.

Figure 43:
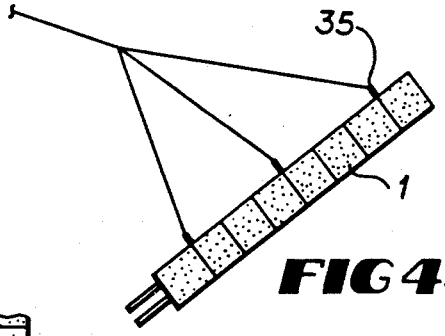
FIG. 43 shows a side elevation view of a type of assembly configuration in an actuated state similar to that position of a tilt-up wall panel during erection.

FIG. 43 shows a side elevation view illustrating a revetment assemblage 47. Component 1 is placed below the water surface. Component 48 reflects a modified component 1 utilizing pipe section 23 as shown in FIG. 27.

Figure 42:
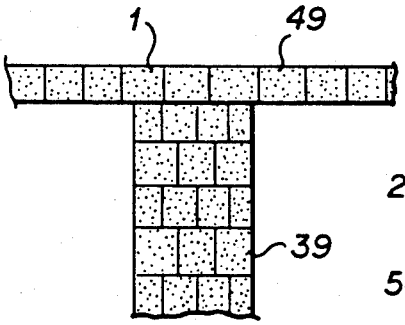
FIG. 42 shows a side elevation view of a combination of assembly configurations that being similar to a column section supporting a slab.

FIG. 42 shows a side elevation view illustrating a horizontal assemblage 49. No forms are required in this above ground surface construction.

FIG. 43 shows a side elevation view of a typical wall assemblage as shown in FIG. 30 in a state of being lifted after, if required, constructed on ground surface utilizing horizontal assemblage 49.

Figure 44:
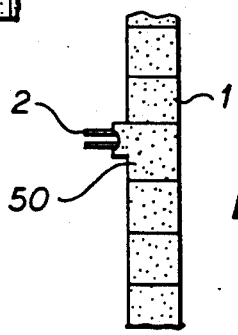
FIG. 44 shows a side elevation view of assembly configurations that being a building wall supporting a slab system with the slab system spandrel section being a specialized truss assembly component with the specialized component being adopted for slab space truss assembly units or for poured slab construction.

FIG. 44 shows a side elevation view of a typical wall assemblage as shown in FIG. 30 with a slab attachment component 50.

FIGS. 45 through 51 show various views of a specialized attachment means typically used with multi-use component 3.

Figure 45:
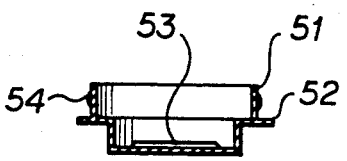
FIGS. 45 and 46 show section views of a specialized easy-use male component of a singular chord member.

FIG. 45 shows a section view of easy-use male element 51. Lip 52 is positioned to fit adjacent to the face of component 1 or multi-use component 3. Ribs 53 structurally stiffen easy-use male element 51 while easy-use male element 51 is placed in an engaged state. Possible protrusion 54 provides for an ease for attaching easy-use male element 51 to multi-use component 3.

Figure 46:
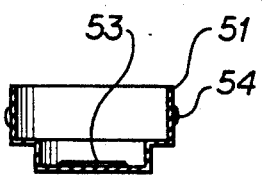

FIG. 46 is similar to FIG. 45, shows the easy-use male element 51 with an elongated tube section providing structural strengthening of the easy-use male element 51 attachment to multi-use component 3.

Figure 47:
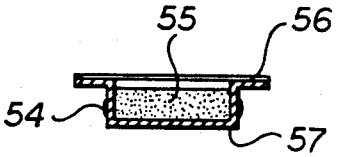
FIG. 47 shows a section view of a specialized easy-use female component of a singular chord member with an epoxy bonding agent.
Figure 48:
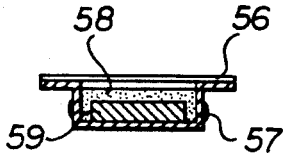
FIG. 48 shows a section view of a specialized easy-use female component of a singular chord member with an epoxy bonding agent and a compressible wafer.
Figure 49:
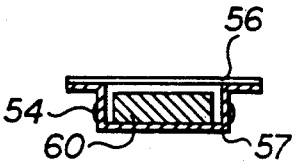
FIG. 49 shows a section view of a specialized easy-use female component of a singular chord member with a compressible wafer.

FIGS. 47 through 49 show section views of the easy-use female element 57 with various materials placed between easy-use female element 57 and seal 56. The material for FIG. 47 is a bonding agent 55. For FIG. 48, the materials are an epoxy bonding agent 58 with an epoxy bonding agent compressible wafer 59. FIG. 49 shows the material being a compressible wafer 60 with possible adhesive qualities.

Figure 50:
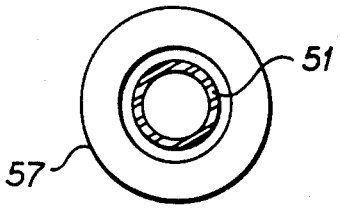
FIG. 50 shows a plan section view of specialized easy-use male and female components of a singular chord member.

FIG. 50 shows a section plan view, taken through the easy-use male element 57 without placement of a bonding agent.

Figure 51:
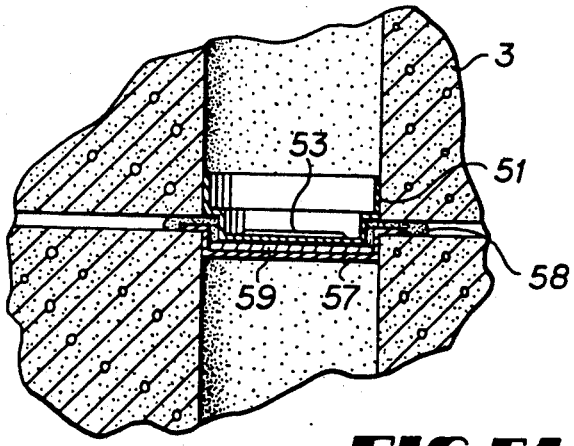
FIG. 51 shows a fragmentary section view of specialized easy-use male and female components of a singular chord member in an engaged state.

FIG. 51 shows a fragmentary section view of the easy-use male element 51 in an engaged state with the easy-use female element 57. Epoxy bonding agent 58 is shown protruding between components 1.

Many apparently different embodiments of the present invention may be made without departing from the spirit and scope of this invention. Therefore, this invention is not limited to the specific embodiments.

I claim:

1. In a modular space truss component, the improvement comprising at least one pipe embedded therein with a prong protruding from one end of said pipe outwardly from the component, said pipe having a bore width larger than the width of said prong and an open end adjacent a surface of the component; a supply of bonding agent disposed within said pipe bore; a seal sealing said pipe open end; and a bonding agent accelerator disposed within said pipe bore and separated from said bonding agent by separator means, whereby upon mounting another modular space truss component of like construction thereto by inserting the other component prong into the tube, the seal and separator means may be ruptured and the bonding agent and bonding agent accelerator intermixed to bond the other component prong to the tube.

2. The improvement in modular space truss components of claim 1 wherein said separator means comprises a capsule in which said bonding agent is contained.

3. The improvement in modular space truss components of claim 2 wherein said capsule is comprised of an elastic material.

4. The improvement in modular space truss components of claim 2 wherein said capsule is mounted to said seal.

5. The improvement in modular space truss components of claim 4 wherein said seal is an end cap.

6. The improvement in modular space truss components of claim 1 wherein said bonding agent is cementitious with an expansive in-place property.

7. The improvement in modular space truss components of claim 1 wherein said bonding agent is epoxy.

8. A modular space truss component having a block shaped body with opposite sides to which other components may be mounted, a pipe embedded in said body with an end located adjacent one of said body sides, bonding material housed within said pipe, bonding catalytic material housed within said pipe an end cap sealing said pipe end, and a prong projected outwardly from said body other side of a size and shape to be inserted into the pipe of another modular space truss component of like construction in constructing an assembly of components.

9. The modular space truss component of claim 8 further comprising a capsule mounted within said pipe in which said bonding catalytic material is contained.

10. The modular space truss component of claim 9 further comprising said capsule of an elastic material.

11. The modular space truss component of claim 9 wherein said capsule is mounted to said end cap.

12. The modular space truss component of claim 8 wherein said prong extends from an end of said pipe opposite said one end.

13. The modular space truss component of claim 8 wherein said block shape body has two openings therethrough separated by a reinforcing member that extends diagonally between opposite corners of said block shaped body.

14. The modular space truss component of claim 13 comprising a second pipe embedded in said body with an end located adjacent said one body side and a second prong projecting outwardly from said body other side, and wherein said pipe, said second pipe, said prong and said second prong are mounted along said reinforcing member located such that another component of like construction may be stacked thereupon with its prongs located with the block opening for storage and transport and later rotated a half turn for insertion into the pipes during the construction of an assembly of the components.

15. The modular space truss component of claim 8 wherein said pipe is comprised of a plurality of chords abutting a shaft surface of said modular space truss component.

16. The modular space truss component of claim 8 wherein said bonding material provides means for a said modular space truss component surface separation within said assembly.

17. Apparatus for use in securing modular space truss components rigidly together comprising a tube of a selected bore size having an open end and a closed end, a prong extending from said tube closed end of a width less than said selected bore size, bonding material housed within said tube, bonding catalytic material housed with said tube separated from said bonding material by a separator; and a seal sealing said tube open end, whereby upon inserting the prong of another apparatus of like construction through the end seal and breaching the separator, the catalytic material and bonding material may be mixed and bond the prong of the other apparatus to the tube.

18. The improvement in apparatus for use in securing modular space truss components of claim 11 wherein said tube is partitioned with said open end having a closure within confines of said modulized space truss component, separated from said closed end of said tube.

19. The improvement in apparatus for use in securing modular space truss components of claim 17 wherein said separator is comprised of an elastic material.

* * * * *